US006692419B2

(12) United States Patent
Chen

(10) Patent No.: US 6,692,419 B2
(45) Date of Patent: Feb. 17, 2004

(54) EXERCISER

(76) Inventor: Ping Chen, No. 29, Nanmei St., Nantun Li, Nantun Dist., Taichung (TW)

( * ) Notice: Subject to any disclaimer, the term of this patent is extended or adjusted under 35 U.S.C. 154(b) by 100 days.

(21) Appl. No.: 10/053,898

(22) Filed: Jan. 24, 2002

(65) Prior Publication Data

US 2003/0139268 A1 Jul. 24, 2003

(51) Int. Cl.[7] ..... A63B 22/14; A63B 22/16

(52) U.S. Cl. ..... 482/146; 482/147; 482/77; 482/78; 482/79; 482/80

(58) Field of Search ..... 482/77, 78, 79, 482/80, 146, 147

(56) References Cited

U.S. PATENT DOCUMENTS 5,368,536 A * 11/1994 Stodgell ..... 482/79
6,176,817 B1 * 1/2001 Carey et al. ..... 482/146

* cited by examiner

*Primary Examiner*—Nicholas D. Lucchesi
*Assistant Examiner*—L Amerson
(74) *Attorney, Agent, or Firm*—Fei-Fei Chao; Venable LLP

(57) ABSTRACT

An exerciser has a base and a rocking plate. The rocking plate is rotatably attached to the base with a ball joint. Consequently, a user can swing or twist body, rotate ankles and develop feet muscles when the user steps on the rocking plate to keep balance. The exerciser can exercise the lower part of the body of a user. This exerciser is more versatile than the prior art.

9 Claims, 7 Drawing Sheets

EXERCISER

BACKGROUND OF THE INVENTION

1. Field of the Invention

The present invention relates to an exerciser, and more particularly to an exerciser that can swing or twist the user's body, rotate the ankles and develop the feet muscles.

2. Description of Related Art

Although indoor exercisers have become popular in recent years, the conventional indoor exerciser only has one function. For example, a rotating exerciser that can twist the user's waist substantially comprises a bottom plate, a top plate and a series of rollers. The top plate is mounted above the bottom plate. The rollers are rotatably mounted between the bottom plate and the top plate. A user can step on the top plate and rotate the top plate relative to the bottom plate. Consequently, the waist of the user can be twisted, and the abdominal muscles of the user are trained.

However, the conventional rotating exerciser only has one function as in the other indoor exercisers, and thus the conventional exerciser is not versatile.

To overcome the shortcomings, the present invention tends to provide an exerciser to mitigate or obviate the aforementioned problems.

SUMMARY OF THE INVENTION

The main objective of the invention is to provide an exerciser that can exercise the lower part of the body of a user. The exerciser has a base and a rocking plate. The rocking plate is rotatably attached to the base with a ball joint. Consequently, a user can swing or twist body, rotate ankles and develop feet muscles when the user steps on the rocking plate to keep balance. This exerciser is more versatile than the prior art.

Other objects, advantages and novel features of the invention will become more apparent from the following detailed description when taken in conjunction with the accompanying drawings.

DETAILED DESCRIPTION OF PREFERRED EMBODIMENT

Figure 1:
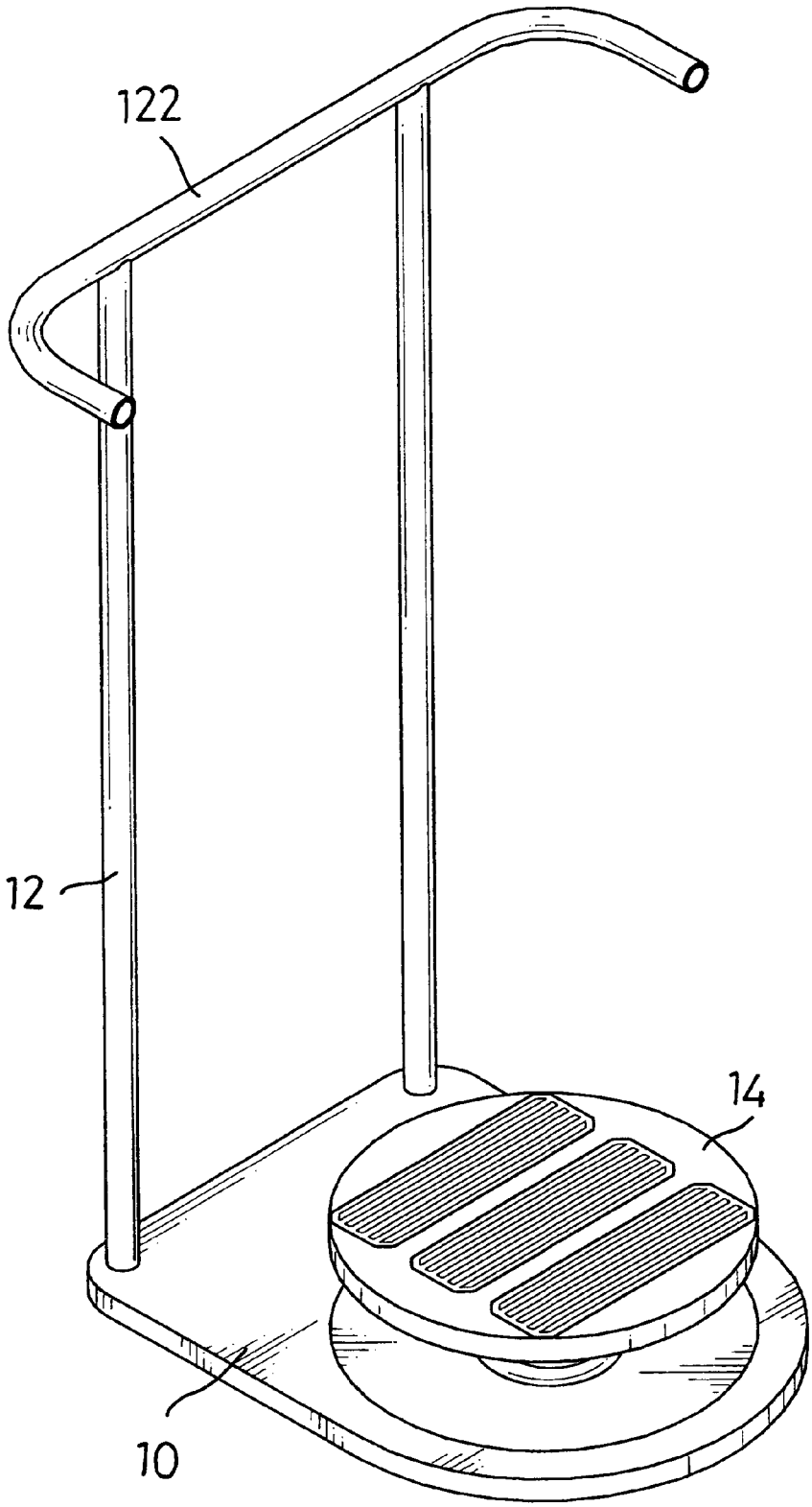
FIG. 1 is a perspective view of an exerciser in accordance with the present invention.

With reference to FIG. 1, an exerciser in accordance with the present invention comprises a base (10) and a rocking plate (14). The rocking plate (14) is rotatably attached to the base (10) with a ball joint. Consequently, the rocking plate (14) will rotate relative to the base (10) when a user steps on the rocking plate (14).

Figure 2:
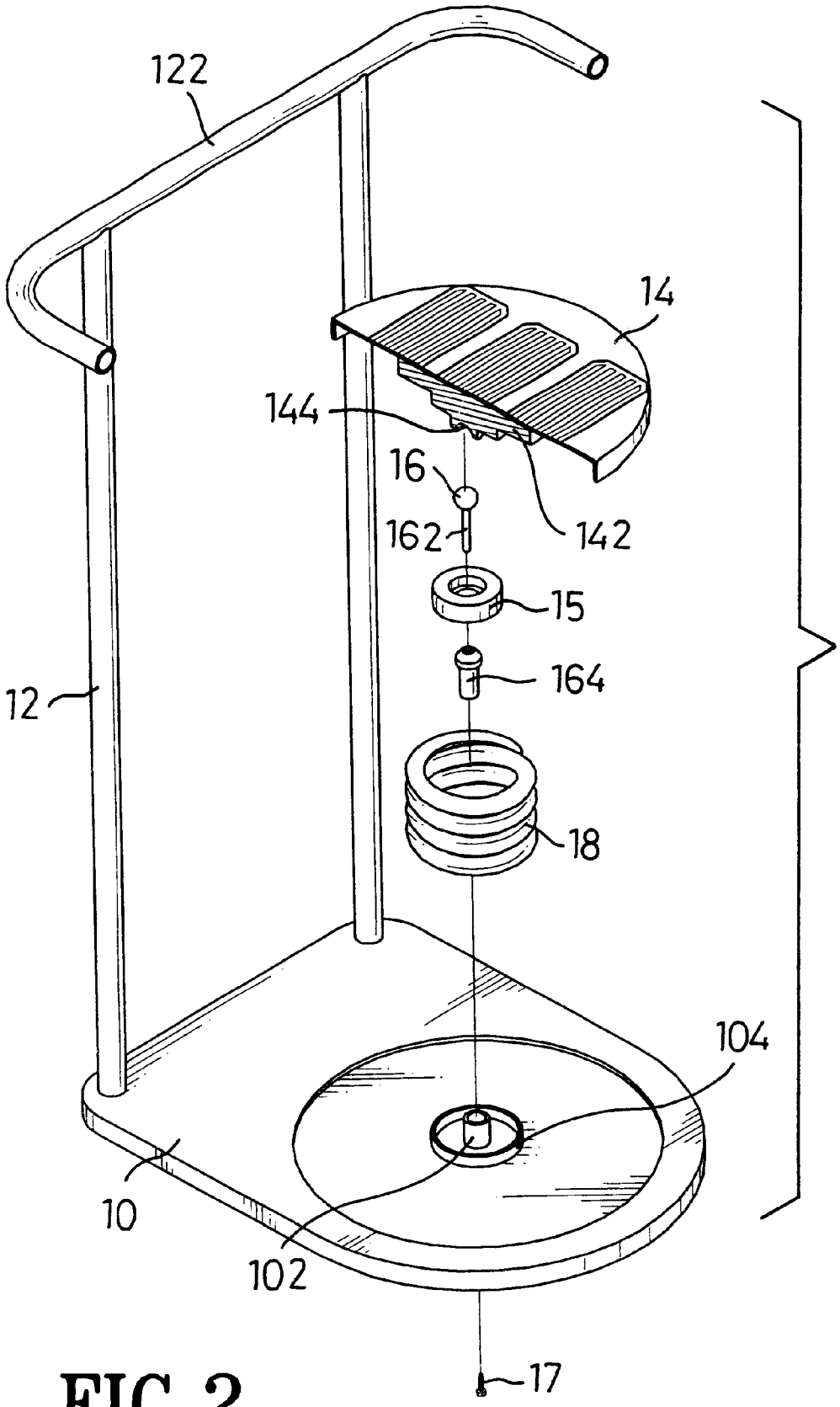
FIG. 2 is an exploded perspective view of the exerciser in FIG. 1.
Figure 3:
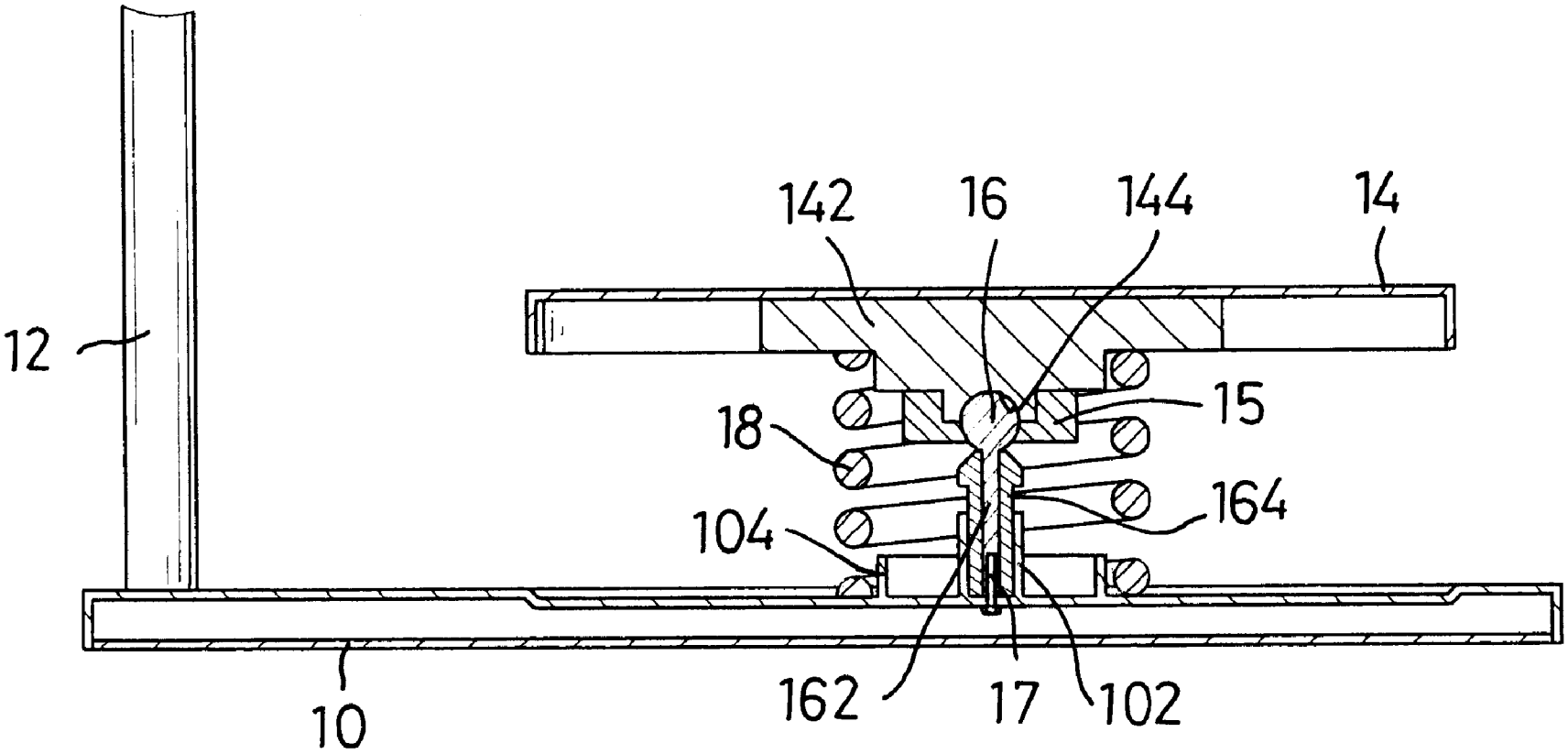
FIG. 3 is a cross sectional side plan view of the base and the rocking plate in the exerciser in FIG. 1.

With reference to FIGS. 2 and 3, the ball joint comprises a ball (16) and a post (162). The ball (16) is rotatably attached to the bottom of the base (10). The post (162) is mounted on the ball (16) and is secured to the base (10). A protrusion (142) is formed on the bottom of the base (10). A recess (144) is defined in the bottom of the protrusion (142) to receive the top part of the ball (16). A collar (15) is attached to the protrusion (142) for the post (162) extending through the collar (15). A recess (not numbered) is defined in the collar (15) to receive the bottom part of the ball (16). Consequently, the ball (16) can be rotatably positioned between the protrusion (142) and the collar (15). In practice, an outer thread is formed on the periphery of the protrusion (142), and an inner thread is defined in the collar (15) to screw with the outer thread on the protrusion (142). In an arrangement of the threads, the collar (15) can be detachably attached to the protrusion (142).

To secure the post (162) to the base (10), a threaded hole is defined in a bottom of the post (162). A bolt (17) extends upward from below and then through the base (10) and is screwed with the threaded hole in the post (162) to secure the post (162) on the base (10). In addition, a sleeve (164) is mounted around the post (162). A tube (102) extends upward from the top of the base (10) to receive the sleeve (164).

In addition, a resilient member is arranged between the base (10) and the rocking plate (14). The resilient member can be a spring (18). One end of the spring (18) is mounted on the protrusion (142), and the other end of the spring (18) is mounted on a circular flange (104) extending upward from the top of the base (10). Two stands (12) are mounted on the base (10). A handlebar (122) is mounted on the tops of the stands (12) for the user to grip the handlebar (122) as the user steps on the rocking plate (14).

Figure 4:
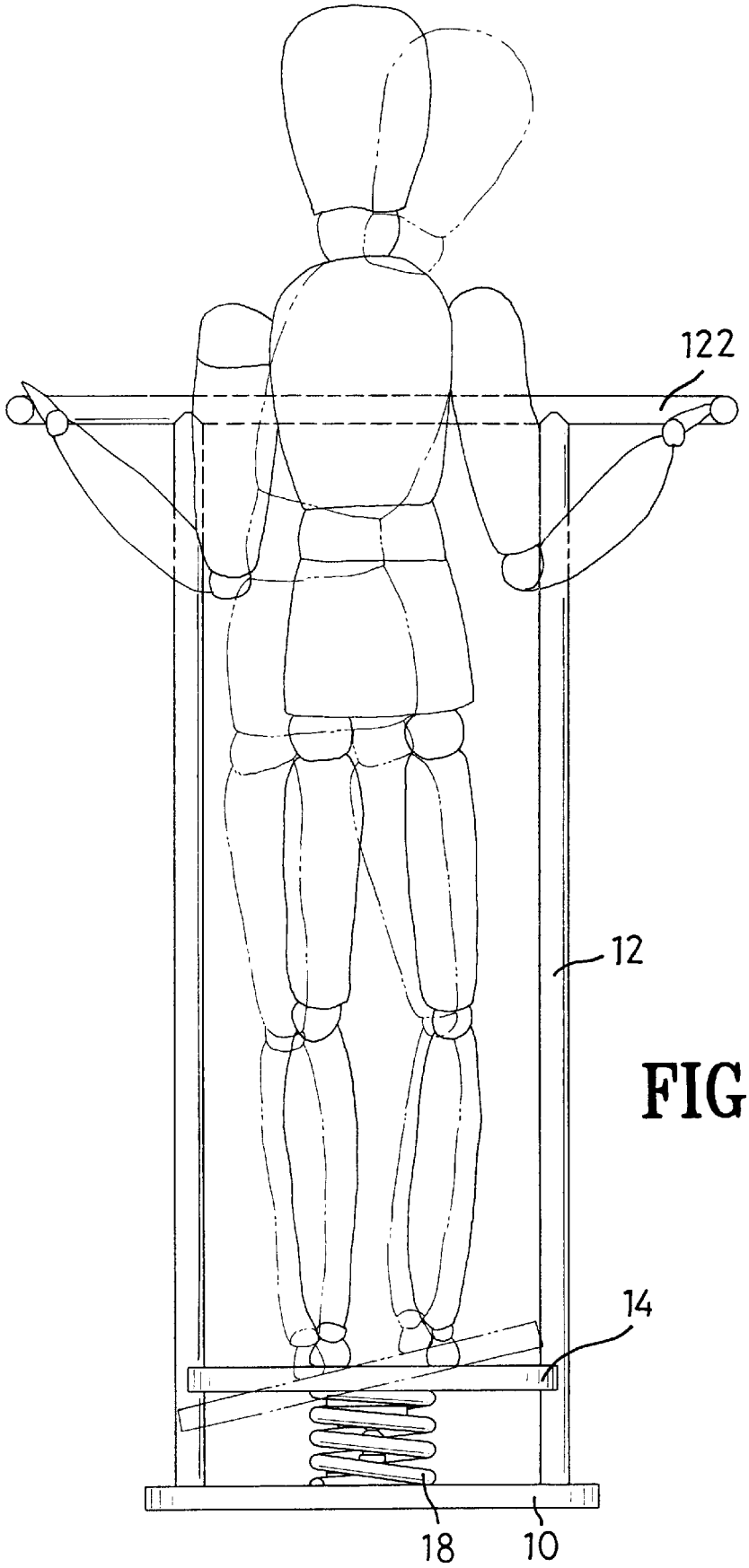
FIG. 4 is an operational front plan view of the exerciser in FIG. 1 showing that a body of user is twisted to keep balance.
Figure 5:
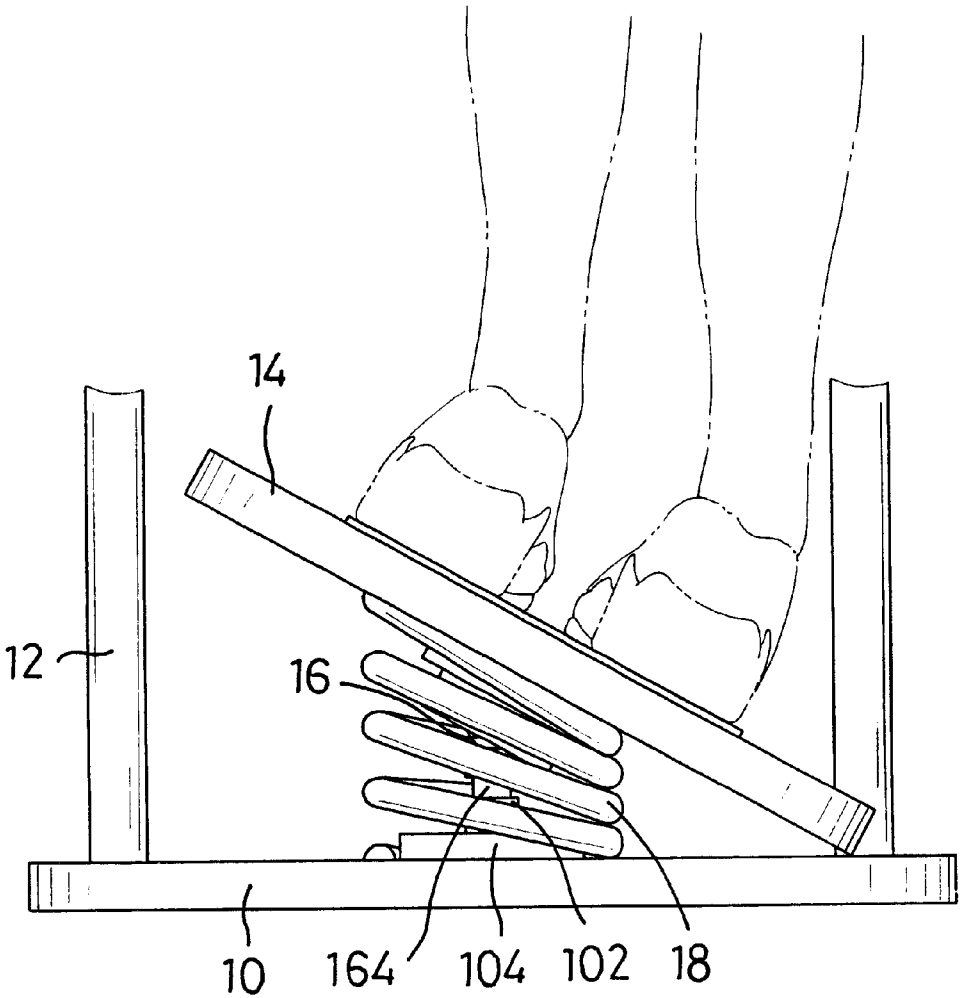
FIG. 5 is an enlarged operational front plan view of the exerciser in FIG. 1 showing that the ankles of the user are rotated as the rocking plate rotates relative to the base.
Figure 6:
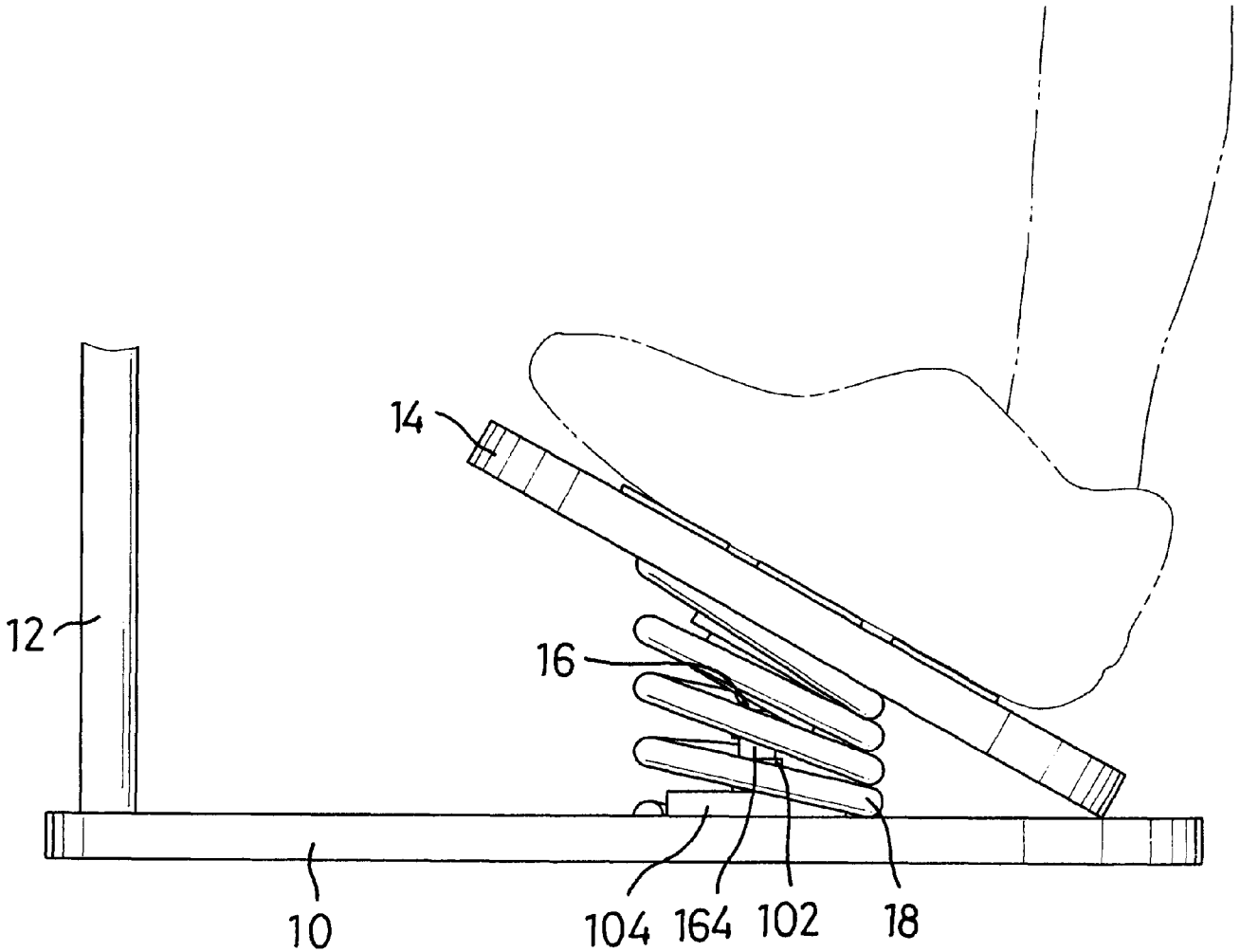
FIG. 6 is an enlarged operational side plan view of the exerciser in FIG. 1 showing that the ankles of the user are rotated so as to develop the feet muscles of the user.

In operation, with reference to FIGS. 4 to 6, the rocking plate (14) will rotate relative to the base (10) with the ball joint when a user steps on it. To keep balance on the rocking plate (14), the ankles and waist of the user must swing or twist in different directions. In addition, because the body of the user is always kept substantially vertical to the horizon, the feet muscles of the user will be developed as the ankles are rotated in a direction as shown in FIG. 6. Accordingly, while trying to maintain balance on the rotatable rocking plate (14) the user's waist and ankles will be twisted or rotated, as well as the feet muscles being developed. Multiple training effects can be gained due to the significant versatility of the exerciser.

In practice, the spring (18) not can only provide a recoil force to the rocking plate (14) to rotate the rocking plate (14) to the original balance position, but also can provide a resisting force to the user as the user steps on the rocking plate (14). In another operational situation, the spring (18) can be detached from the exerciser. Without the spring (18), the rotating speed of the rocking plate (14) is increased, and thus the user is especially challenged to keep the rocking plate (14) in balance, whereby the user can gain a further exercising effect.

Figure 7:
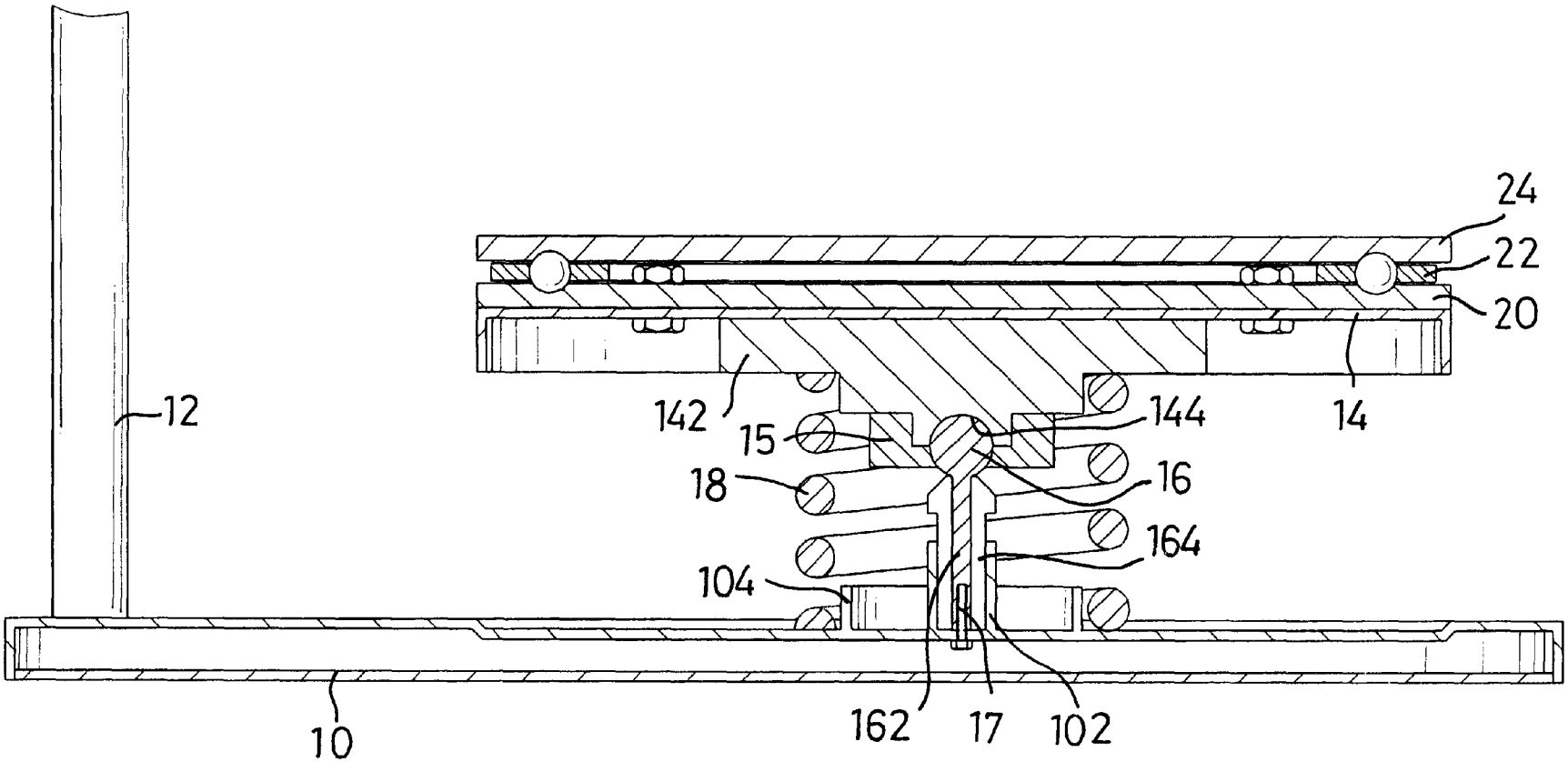
FIG. 7 is an enlarged cross sectional side plan view of the exerciser in FIG. 1 with a rotating exercising device mounted on the rocking plate.

In another embodiment, with reference to FIG. 7, a rotating exercising device is attached to the top of the rocking plate (14). The rotating exercising device comprises a bottom plate (20), a top plate (24) and a series of rollers. The bottom plate (20) is detachably attached to the top of the rocking plate (14) with bolts and nuts. The top plate (24) is put above the bottom plate (20). The rollers are rotatably mounted between the bottom plate (20) and the top plate (24) in a circle. In practice, a circular race (22) is mounted between the bottom plate (20) and the top plate (24) to receive the rollers.

With the rotating exercising device, the body of the user can be further twisted in a large angle by means of rotating the top plate (24) relative to the bottom plate (20), such that a further exercising effect is achieved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exerciser comprising:

a base; and a rocking plate rotatably attached to the base with a ball joint, said rocking plate having a top and a bottom;

wherein the ball joint comprises a ball rotatably attached to the bottom of the rocking plate, and a post with a bottom mounted on the ball and secured to the base; and wherein a protrusion with a bottom is formed on the bottom of the rocking plate; a first recess is defined in the bottom of the protrusion to receive a top part of the ball; and a collar is attached to the protrusion for the post to extend through the collar and has a second recess defined in the collar to receive a bottom part of the ball, whereby a user's body can be twisted or swung, or ankles rotated when the user steps on the rocking plate to keep balance.

2. The exerciser as claimed in claim 1 further comprising a sleeve mounted around the post; and a tube extending upward from the base to receive the sleeve.

3. The exerciser as claimed in claim 2, wherein a threaded hole is defined in the bottom of the post; and a bolt extends through the base and is screwed into the threaded hole in the post to secure the post on the base.

4. The exerciser as claimed in claim 1 further comprising a resilient member arranged between the base and the rocking plate.

5. The exerciser as claimed in claim 4 wherein the resilient member is a spring having a first end mounted on the protrusion and a second end; and a circular flange extending upward from a top of the base for the second end of the spring mounting on the circular flange.

6. The exerciser as claimed in claim 1 further comprising at least one stand mounted on the base; and a handlebar mounted on the at least one stand for the user to grip the handlebar as the user steps on the rocking plate.

7. The exerciser as claimed in claim 1 further comprising a rotating exercising device attached on the top of the rocking plate.

8. The exerciser as claimed in claim 7 wherein the rotating exercising device comprises:

a bottom plate detachably attached to the top of the rocking plate;

a top plate mounted above the bottom plate; and a series of rollers rotatably mounted between the bottom plate and the top plate in a circle.

9. The exerciser as claimed in claim 8, wherein a circular race for receiving the rollers is mounted between the bottom plate and the top plate.

* * * * *